US011013279B2

(12) United States Patent
Furukawa et al.

(10) Patent No.: US 11,013,279 B2
(45) Date of Patent: May 25, 2021

(54) FASTENER FOR WIG AND WIG USING THE SAME

(71) Applicants: Aderans Company Limited, Tokyo (JP); Kawakita Inc., Osaka (JP)

(72) Inventors: Masaaki Furukawa, Tokyo (JP); Yoshihiro Tsumura, Tokyo (JP); Yukitomo Kawakita, Osaka (JP); Yasuhiro Kawakita, Osaka (JP)

(73) Assignees: ADERANS COMPANY LIMITED, Tokyo (JP); KAWAKITA INC., Osaka (JP)

( * ) Notice: Subject to any disclaimer, the term of this patent is extended or adjusted under 35 U.S.C. 154(b) by 286 days.

(21) Appl. No.: 15/537,680

(22) PCT Filed: Jan. 27, 2016

(86) PCT No.: PCT/JP2016/052374
§ 371 (c)(1),
(2) Date: Jun. 19, 2017

(87) PCT Pub. No.: WO2016/125662
PCT Pub. Date: Aug. 11, 2016

(65) Prior Publication Data

US 2017/0354193 A1 Dec. 14, 2017

(30) Foreign Application Priority Data

Feb. 6, 2015 (JP) ..... JP2015-022532

(51) Int. Cl.
*A61G 3/00* (2006.01)
*A41G 3/00* (2006.01)

(52) U.S. Cl.
CPC ..... *A41G 3/0033* (2013.01); *A41G 3/00* (2013.01)

(58) Field of Classification Search
CPC ..... A41G 3/00; A41G 3/0033; A41G 3/0008; A41G 5/0013; A41G 5/0053; A45D 8/12; A45D 8/24; A45D 8/30
(Continued)

(56) References Cited

U.S. PATENT DOCUMENTS

2010/0236566 A1* 9/2010 Carey Stachowski ... A45D 8/14 132/200
2014/0326263 A1* 11/2014 Miyatake ..... A41G 3/0033 132/54
2016/0050996 A1* 2/2016 Kwon ..... A41G 3/0033 132/201

FOREIGN PATENT DOCUMENTS

CH 387959 A * 2/1965 ..... A45D 8/12
CN 1611159 5/2005
(Continued)

OTHER PUBLICATIONS

International Search Report dated Apr. 19, 2016 in International (PCT) Application No. PCT/JP2016/052374.

*Primary Examiner* — Tatiana L Nobrega
*Assistant Examiner* — Sarah Woodhouse
(74) *Attorney, Agent, or Firm* — Wenderoth, Lind & Ponack, L.L.P.

(57) ABSTRACT

A fastener for a wig having two approximately U-shape members, each configured of a comb teeth fixed piece, and two curved elastic leg portions which extend from both ends of the comb teeth fixed piece. The two approximately U-shape members are connected to each other at a plurality of connecting points located away from each other in a direction that each of the curved elastic leg portions extends under the condition that opening portions of the approximately U-shape members face each other and the curved elastic leg portions are overlapped each other. Accordingly, both members have both a high elastic deformation capa-
(Continued)

bility and a high integrity. Therefore, during the operation such that the fastener for a wig are reversed by fingers, if one of the approximately U-shape members is reversed, the other approximately U-shape member is always reversed at the same time, one reversing operation is always enough.

7 Claims, 6 Drawing Sheets

(58) Field of Classification Search
USPC ... 132/276, 101, 105, 60, 63.1, 53, 280, 278
See application file for complete search history.

(56) References Cited

FOREIGN PATENT DOCUMENTS

| | | | | |
|---|---|---|---|---|
| JP | 56-23294 | | | 6/1981 |
| JP | 58-60003 | | | 4/1983 |
| JP | 62-50503 | | | 3/1987 |
| JP | 2011-149110 | | | 8/2011 |
| JP | 2011149110 | A | * | 8/2011 |
| JP | 2013-40430 | | | 2/2013 |
| JP | 2014-84542 | | | 5/2014 |

* cited by examiner

FASTENER FOR WIG AND WIG USING THE SAME

FIELD OF INVENTION

The present invention relates to a fastener for a wig to fix the wig to a wearer's head. More specifically, the present invention relates to a fastener for a wig which can facilitate removal of the wig, and a wig which uses this fastener. A fastener for a wig is configured by connecting and fixing two approximately U-shape members. Each of the approximately U-shape members is configured of a comb teeth fixed piece 11 to which comb teeth 20 are fixed, and two curved elastic leg portions 12, 13 which extend from both ends of the comb teeth fixed piece in the same direction which is approximately perpendicular to the comb teeth fixed piece. The two approximately U-shape members are connected to each other at a plurality of connecting points located away from each other in a direction that each of the curved elastic leg portions 12, 13 extends under the condition that opening portions 15 of the approximately U-shape members face each other and the curved elastic leg portions 12,13 are overlapped each other. Accordingly, both members have both a high elastic deformation capability and a high integrity. Therefore, during the operation such that the fastener S for a wig are reversed by fingers, if one of the approximately U-shape members 10 is reversed, the other approximately U-shape member 10 is always reversed at the same time (one reversing operation is always enough).

BACKGROUND

In the case that wearer's own hairs remain, for example, a fastener described in the Patent document 1 has been widely used, as a method for fixing a wig to the wearer's head. This type of fastener is provided with comb teeth which clamp and fix the own hairs at one longer side of a frame with inverting ability. The fastener is connected to a rear side of the wig such that the comb teeth are positioned in parallel to an extending direction of the own hairs. In this case, since the extending direction of the comb teeth is parallel to the extending direction of the own hairs, there is a problem such that a clamping strength of the comb teeth to clamp the own hairs is low, and a stable fixing strength cannot be obtained if enough amount of own hairs do not exist.

Further, if the head moves in the lateral direction to the extending direction of the comb teeth, the own hairs will easily slip from the comb teeth. On the contrary, if the head moves in parallel to the extending direction of the comb teeth, the own hairs may be pulled by the comb teeth, and the wearer tends to feel pain. Further, there is also a case such that hair loss progresses by using the fastener at the same position for a long time.

In order to improve the above-mentioned defects, there is disclosed a fastener for a wig which is provided with comb teeth at left and right shorter sides of a frame with inverting ability in Patent documents 2 and Patent documents 3.

In the fastener described in Patent document 2, 3, since the fastener is connected to a rear side of the wig such that the comb teeth are positioned in perpendicular to an extending direction of the own hairs, the pain caused due to the pulled hairs will be reduced compared to the case of Patent document 1. However, each of the fasteners of Patent documents 2, 3 has the following problems because it has a construction such that two framing portions forming the left and right shorter sides to which the comb teeth are attached are connected together and integrated at the center position thereof.

Thus, when a wig is removed from the head, it is necessary to reverse the frames of the fastener to release the condition that the comb teeth clamp the own hairs. At this moment, since the fastener has the construction such that two framing portions at left and right are connected at one central position, it is impossible to reverse both framing portions by one operation of reversing the frame, and thereby requiring at least two revering operations. Otherwise, in many cases, the comb teeth at the intended side do not open due to loading strength or the loading position of the framing portion. Therefore, the wearer tends to feel the attaching and removing operation of the wig to be troublesome (this issue will be explained in the description of embodiments with referring to FIG. 4).

PRIOR ARTS

Patent Document

Patent document 1: JU S56(1981)-23294A
Patent document 2: JP 2011-149110A
Patent document 3: JP 2013-40430A

SUMMARY OF INVENTION

Problem to be Solved

The present invention is made according to the above-mentioned actual status of the prior arts. A purpose of the present invention is specifically to enhance operability at removing a wig from the head, relating to a fastener for a wig which is connected to the wig such that comb teeth thereof are positioned in approximately perpendicular to an extending direction of own hairs of a wearer.

Means for Solving Problem and Effect of Invention

A fastener for a wig according to the present invention is connected to an inside surface of the wig and clamps wearer's own hairs, and thereby fixing the wig to a wearer's head, and comprises two approximately U-shape members. Each of the approximately U-shape members is configured of a "comb teeth fixed piece to which comb teeth are fixed", and "two curved elastic leg portions which extend from both ends of the comb teeth fixed piece in the same direction which is approximately perpendicular to the comb teeth fixed piece".

The two approximately U-shape members are connected to each other at a plurality of connecting points located away from each other in a direction that each of the curved elastic leg portions extends under the condition that opening portions of the approximately U-shape members face each other and the curved elastic leg portions are overlapped each other. An open position and a closed position may be selected by reversing the bending direction of the curved elastic leg portions, in the open position, the "comb teeth are raised away from the curved elastic leg portions", and in the closed position, the "comb teeth extend along the curved elastic leg portions".

Effect of Invention

According to the fastener for a wig according to the present invention which has the above-mentioned configuration, the two approximately U-shape members are connected to each other at a plurality of connecting points located away from each other in a direction that each of the curved elastic leg portions extends under the condition that the curved elastic leg portions are overlapped each other. Accordingly, both of the approximately U-shape members have both a high elastic deformation capability and a high integrity. Therefore, during an operation that the fastener for a wig is reversed by fingers, if one of the approximately U-shape members is reversed, the other approximately U-shape member is always reversed at the same time. In other words, the situation such that "only one of the approximately U-shape members is reversed, which results in requiring two of reversing operations" does not occur.

Accordingly, during the reversing operation, it is possible to reverse the fastener for a wig certainly only by one easy reversing operation without bothering about details relating to how to touch the fastener with fingers, a degree of applied force and a direction thereof (it is possible to remove a wig easily and certainly only by one reversing operation).

DESCRIPTION OF EMBODIMENT

Figure 1:
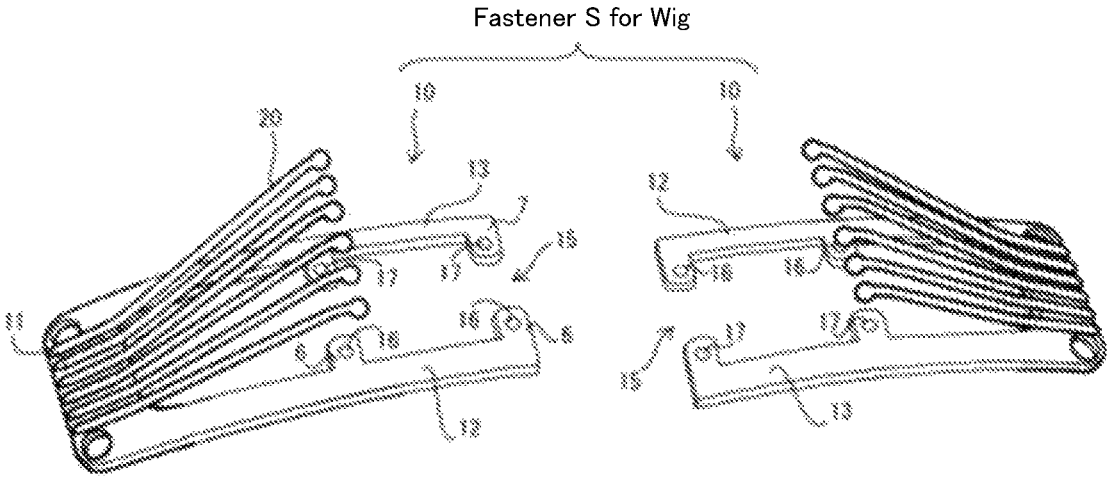
FIG. 1 is an exploded perspective view for illustrating a fastener for a wig according to one embodiment of the present invention with dividing into two approximately U-shape members.

Embodiments according to the present invention are hereinafter described with referring to attached drawings. FIG. 1 illustrates two approximately U-shape members 10 which form a fastener S for a wig according to one embodiment. In this embodiment, one fastener S for a wig is configured of two approximately U-shape members 10 which are identical. Therefore, a configuration will be hereinafter described only for one approximately U-shape member 10.

<<Configuration of Approximately U-Shape Member>>

Figure 2A:
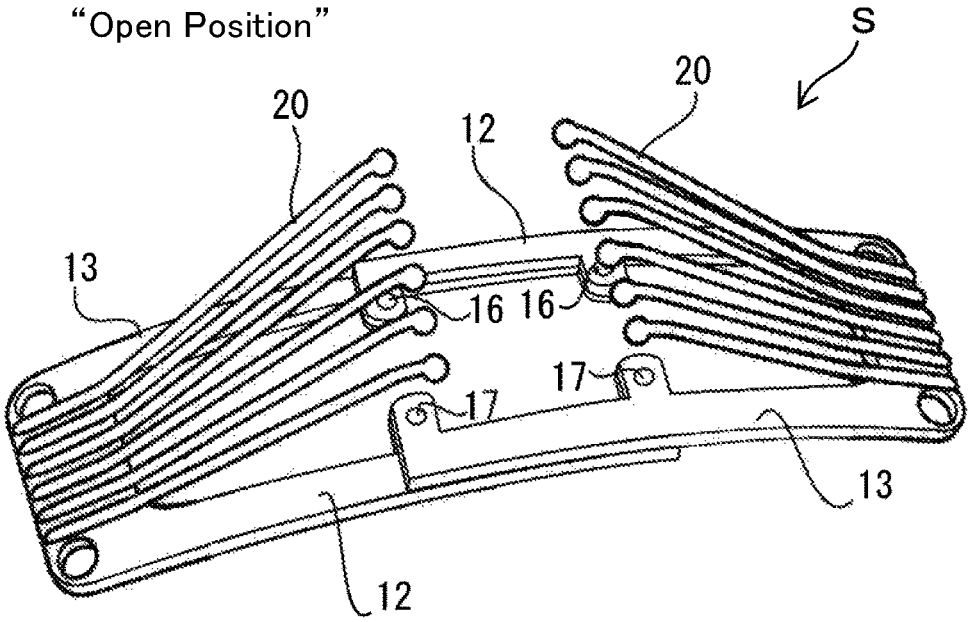
FIGS. 2A and 2B are drawings for describing an open position and a closed position of the fastener for a wig of FIG. 1.
Figure 2B:
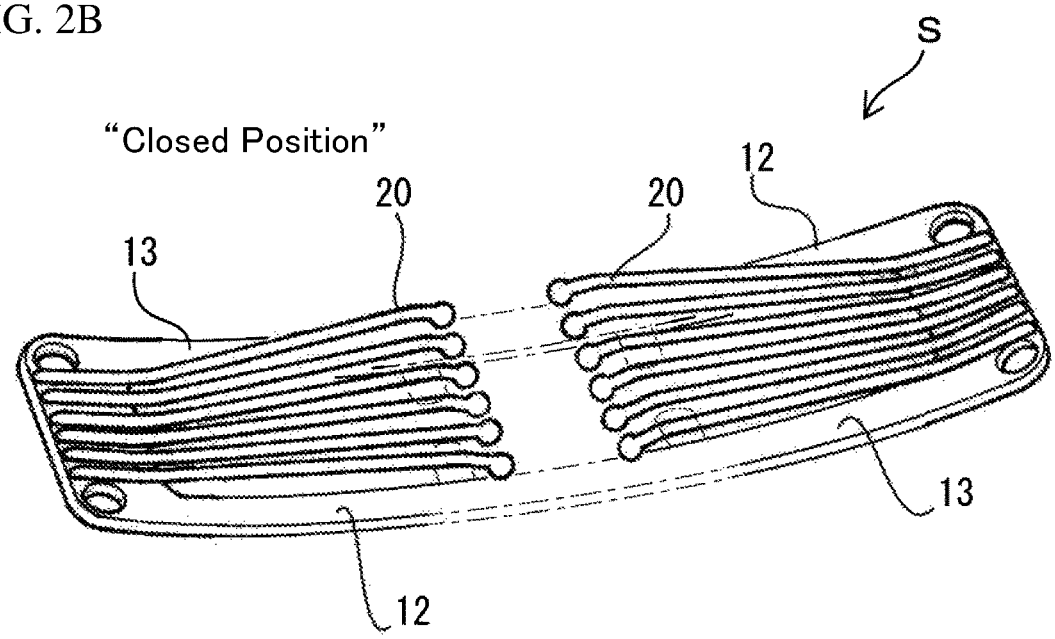

The approximately U-shape member 10 is configured of a comb teeth fixed piece 11 to which comb teeth 20 are fixed, and two curved elastic leg portions 12, 13 which extend from both ends of the comb teeth fixed piece 11 in the same direction which is approximately perpendicular to the comb teeth fixed piece 11. The curved elastic leg portions 12, 13 are not flat members. The curved elastic leg portions 12, 13 have shapes positioned in a hypothetical curved surface, and it may selectively take an "open position" and a "closed position" as described below (FIGS. 2A and 2B).

Firstly, opening portions 15 of the two approximately U-shape members 10, 10 face each other, and then the condition such that the curved elastic leg portions 12, 13 are overlapped each other is made. Under this condition, the curved elastic leg portions 12, 13 are connected to each other at a plurality of connecting points (in this embodiment, connecting holes 16, 17) located away from each other in a direction that each of the curved elastic leg portions 12, 13 extends. This condition is shown in FIG. 2A.

At the connecting holes 16, 17, for example, the curved elastic leg portions 12, 13 which are overlapped each other are connected with using caulking pieces such as rivets (not shown). Accordingly, one fastener S for a wig is configured with using the two approximately U-shape members 10.

<<Open Position and Closed Position>>

The two approximately U-shape members 10 and comb teeth 20 are made of an elastic material such as a metallic material or others. Therefore, the fastener S for a wig may selectively take two conditions such that a bending direction of the curved elastic leg portions is different, as shown in the "open position" of FIG. 2A and the "closed position" of FIG. 2B, by adding an appropriate external force with fingers or the like, and thereby reversing the curved elastic leg portions. In FIG. 2B, the connecting portion (a central portion of the drawing) of the two curved elastic leg portions is schematically illustrated by the dashed line.

Figure 3B:
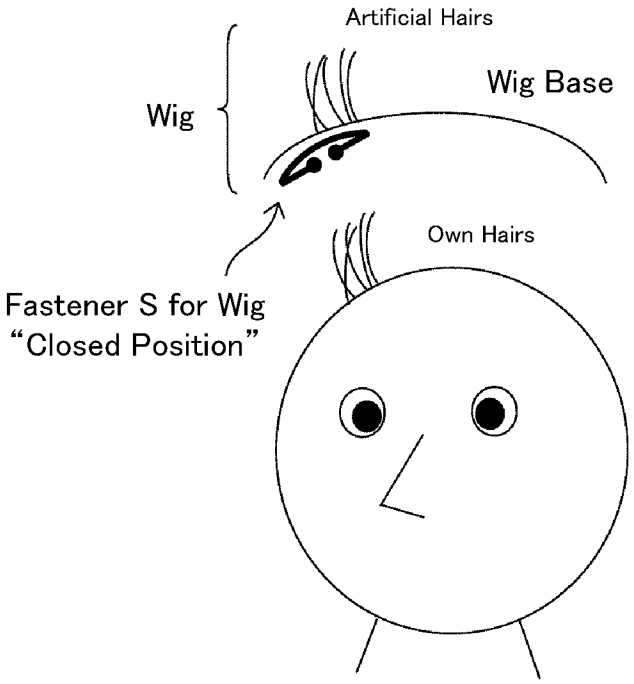
FIGS. 3A and 3B are drawings for describing an open position and a closed position of the fastener for a wig of FIG. 1.

In the "closed position" of FIG. 2B, the comb teeth 20 extend almost along the curved elastic leg portions 12, 13. This indicates the condition that the wig is fixed to the own hairs of the wearer. While FIG. 3B schematically illustrates the condition that the fastener S for a wig is connected to the inner surface of the wig base, the wig is fixed to the head by making the fastener S for a wig clamp the own hairs when the fastener S for a wig is at the "closed position (In FIG. 3B, the wig and the head are illustrated as located apart from each other for a clear illustration).

When the wig is removed, the "open position" of FIG. 2A is taken by reversing the fastener S for a wig. In this position, the comb teeth 20 are raised away from the curved elastic leg portions 12, 13. As illustrated in the corresponding FIG. 3A, when the fastener S for a wig is in the "open position", the own hairs which have been clamped are released, and therefore the wig may be removed from the head.

<<Effect in Comparison with Prior Example>>

Figure 4B:
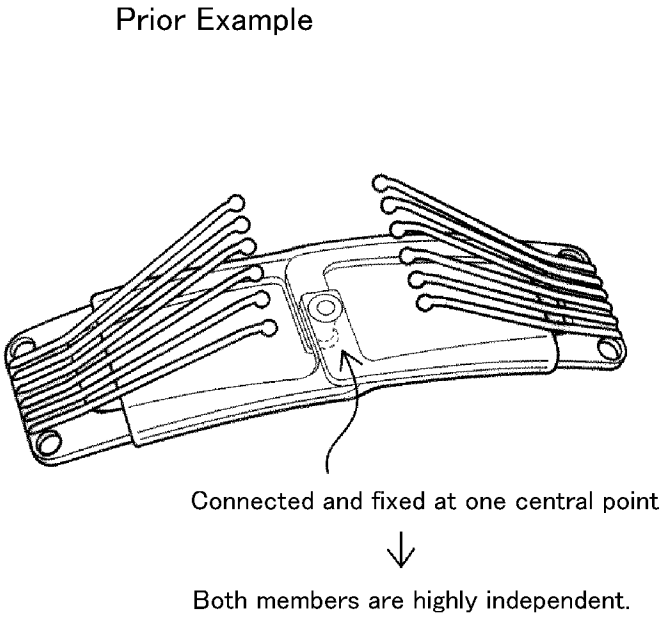
FIGS. 4A and 4B are drawings for describing an advantage of the fastener for a wig according to the present invention in comparison with a prior example.
Figure 4A:
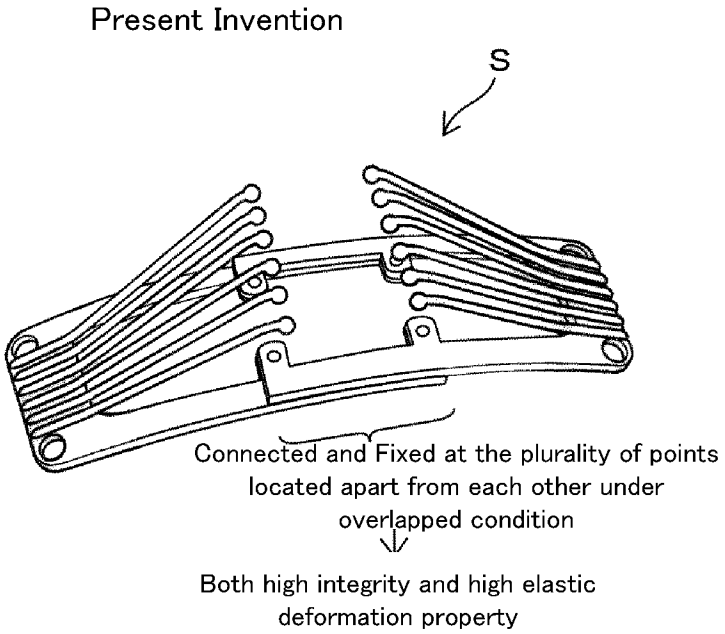

The effect of the present invention is described in comparison with referring to FIG. 4. FIG. 4A illustrates the fastener S for a wig shown in FIG. 2A again. On the contrary, FIG. 4B illustrates a fastener for a wig of Patent document 3 (JP 2013-40430A) described in the front portion of the specification (Patent document 3 is the prior application of the applicant).

According to the fastener S for a wig according to the present invention (FIG. 4*a*), the two approximately U-shape members 10, 10 are connected to each other at the plurality of connecting points along the longitudinal direction (extending direction) under the condition that the curved elastic leg portions are overlapped each other. Accordingly, both of the approximately U-shape members 10, 10 have both a high elastic deformation capability and a high integrity. Therefore, during the operation such that the fastener S for a wig are reversed by fingers, if one of the approximately U-shape members 10 is reversed, the other approximately U-shape member 10 is always reversed at the same time.

In other words, the situation such that "only one of the approximately U-shape members is reversed, which results in requiring two reversing operations" does not occur.

On the contrary, in the fastener for a wig of the prior example (FIG. 4B), since two members at left and right simply come into contact and connected at one position, the two members are highly independent. Due to such configuration, it is possible that only one of the member is reversed according to the degree of applied force during the reversing operation. In this case, the wearer finally feels such operation to be troublesome because two reversing operations are required.

<<Number of Connecting Point>>

In the embodiment illustrated in FIG. 1 and FIG. 2, two of the connecting points (connecting holes 16, 17) are provided along the longitudinal direction (extending direction) of the curved elastic leg portions 12, 13 of the approximately U-shape members 10 (Since two connecting points exist per one leg portion, total four connecting portions exist). From the view point of enhancing integrity of the two approximately U-shape members 10, a large number of the connecting points will be preferable. Therefore, three or more of the connecting points may be provided. On the contrary, if too many connecting points are provided, an adequate elastic deformation (reversing property of the fastener S for a wig) will be lost.

Taking the above-mentioned issues into account, it is preferable to provide adequate number such as two or more of the connecting points accordingly.

<<Arrangement of Connecting Point>>

In the embodiment illustrated in FIG. 1 and FIG. 2, protruding portions 6, 7 which protrude inwardly and face each other are provided in two of the curved elastic leg portions 12, 13 of the approximately U-shape members 10. The connecting holes 16, 17 are formed in the protruding portions 6, 7, and the connecting holes 16, 17 work as the connecting points of the two curved elastic leg portions.

Accordingly, the connecting points exist at the offset position located inside the curved elastic leg portions 12, 13 themselves, which brings the following advantage. The advantage is hereinafter described with referring to FIG. 5.

Figure 5A:
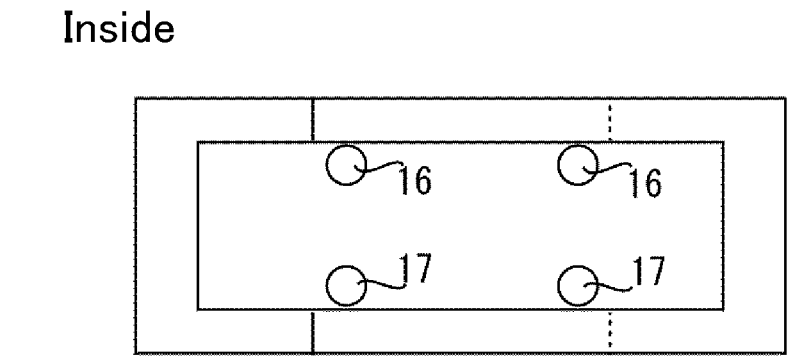
FIGS. 5A-5C are drawings for describing an arrangement of connecting points of the approximately U-shape members in the fastener for a wig.

FIG. 5 schematically illustrates relative positions of the connecting holes 16, 17 in the fastener S for a wig after assembly. The two approximately U-shape members 10 which are overlapped together are shown as a simple frame work, and an illustration of the comb teeth 20 are omitted. FIG. 5(A) corresponds to the embodiment of FIGS. 1,2, and the connecting holes 16, 17 exists inside.

Figure 5B:
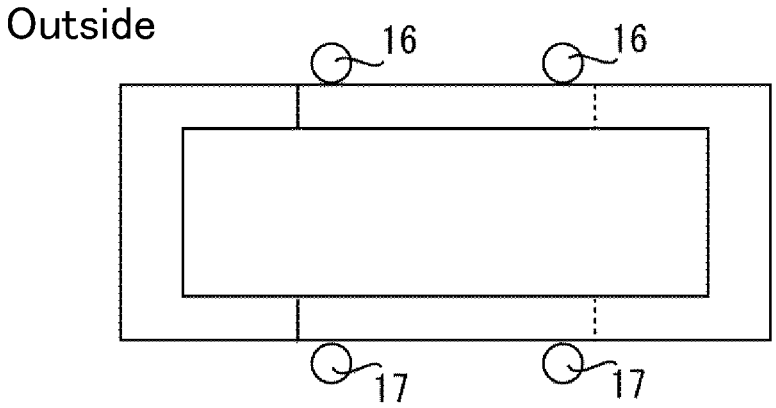

FIG. 5(B) illustrates the case that the connecting holes 16,17 are provided in the connecting portions (not illustrated) which extrude outwardly. In this case, it is not preferable because it may be considered that the own hairs entwine the protruding parts, or the scalp is injured. Further, in the case that a cylindrical member 30 such as a silicon tube is installed (described later with referring to FIG. 6), the cylindrical member 30 tends to be damaged. Therefore, it is not preferable in this point.

Figure 5C:
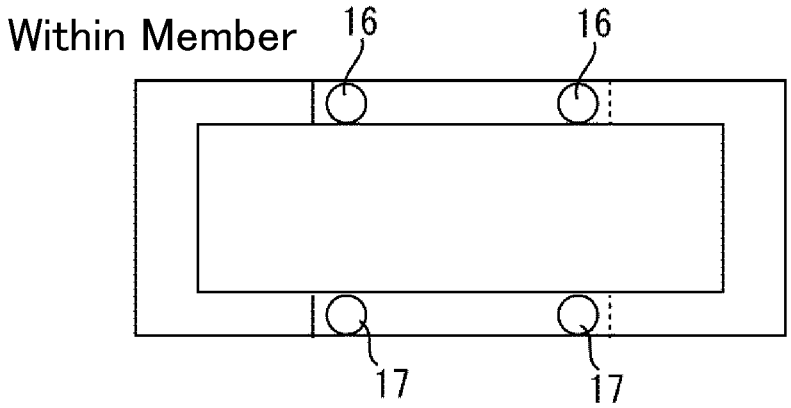

FIG. 5(C) illustrates the case that the connecting holes 16, 17 are located within the members of the curved elastic leg portions 12, 13 themselves. In this case, it is not preferable in the view point of durability because a large load is applied to the curved elastic leg portions 12, 13 due to repeat of the reversing operation. Further, it is not preferable because it cannot utilize elastic deforming property of the curved elastic leg portions 12, 13 themselves, and the force for holding the hairs becomes weak.

Taking the above-mentioned issues into account, the configuration such that the connecting holes 16, 17 exist inside as illustrated in FIG. 5(A) is most preferable. While the configurations of FIG. 5(B) and FIG. 5(C) are inferior to the configuration of FIG. 5(A) in the above-mentioned points, it may obtain the effect such that the reversing operability is improved as described with referring to FIG. 4.

<<Connecting Mode at Connecting Point>>

In the embodiment illustrated in FIG. 1 and FIG. 2, the connecting holes 16, 17 are applied as the connecting points, and a fixing work is performed by inserting the caulking pieces such as rivets (not illustrated) and deforming them. However, in the present invention, the curved elastic leg portions 12, 13 which are overlapped each other are connected and fixed in anyway at the plurality of connecting points located apart from each other along the longitudinal direction (extending direction) of the curved elastic leg portions 12, 13.

For example, fixing work may be performed by winding the string to the connecting holes 16, 17 or by using threaded fasteners. Further, fixing work may be performed at the plurality of points located apart from each other by using adhesive agent or by spot welding without using the connecting holes.

<<Cylindrical Member 30>>

Figure 6:
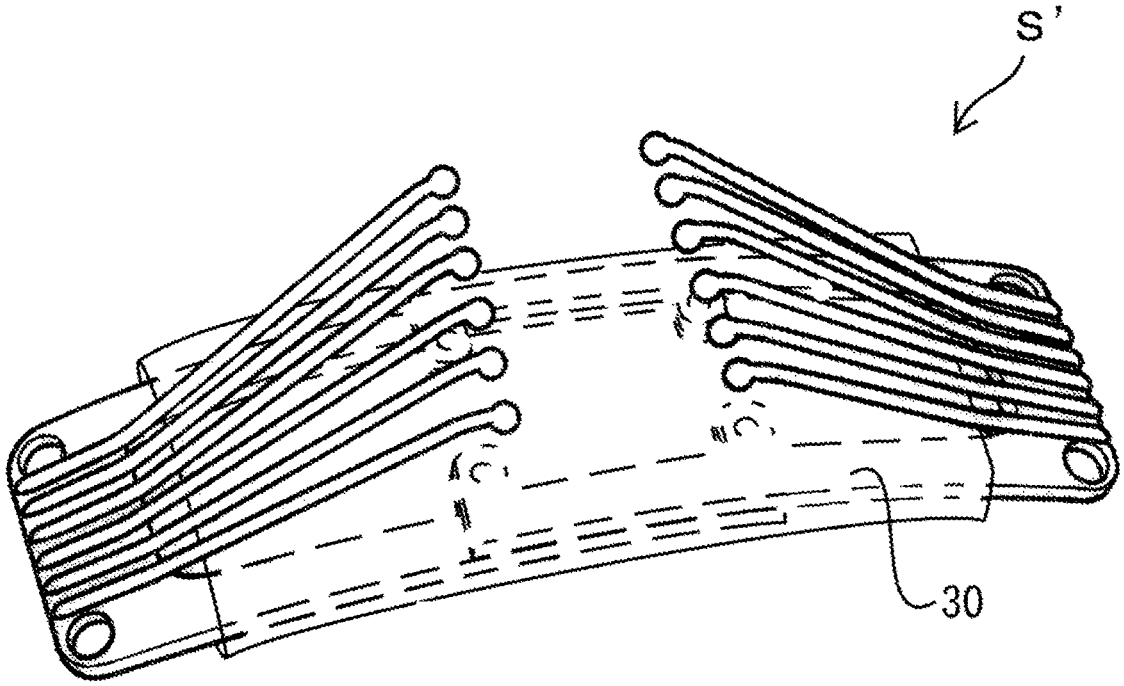
FIG. 6 is a perspective view for illustrating a fastener for a wig according to another embodiment of the present invention, further having a cylindrical member.

FIG. 6 illustrates a fastener S' for a wig according to another embodiment of the present invention. This fastener S' for a wig is different from the fastener S for a wig illustrated in FIGS. 1, 2 in the point of adding a cylindrical member 30, and the other points are the same.

The cylindrical member 30 is inserted onto the curved elastic leg portions 12, 13 which are overlapped each other and fixed together, in the manner of surrounding the curved elastic leg portions 12, 13. In the case that the cylindrical member 30 exists, if the fastener S' for a wig is in the "closed position" as illustrated in FIG. 2B, a force of clamping the own hairs between the comb teeth 20 and the cylindrical member 30 becomes larger, and thereby fixing the wig stably.

The cylindrical member 30 may be made of any material. It is, however, preferable to use silicon, rubber or other elastic materials.

Figure 3A:
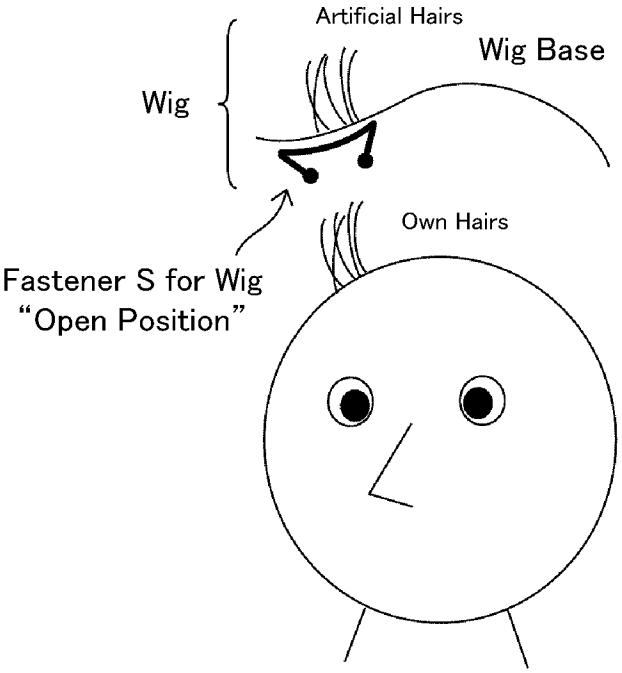

As being understood in FIGS. 3A,B, an inner surface of the wig base is located at the upper side of the fastener for a wig during use of the wig. Therefore, even if the cylindrical member 30 does not exist, it may obtain the function of clamping the own hairs by the inner surface (or any member attached to the inner surface) of the wig base together with the comb teeth 20. Accordingly, the cylindrical member 30 is not a mandatory element, but it is preferable element to be installed.

Other Embodiment

In the illustrated embodiments, the fastener for a wig is configured by using, and connecting and fixing two of the same (one kind of) two approximately U-shape members 10. In this case, it is advantageous in the view point of a simplified manufacturing process and a cost down because it is enough to prepare only one kind of the member.

However, it is not necessary to use two approximately U-shape members which are completely the same. It is possible to use two approximately U-shape members which are different from each other as far as the fastener for a wig which is substantially similar to those described so far by combining these two approximately U-shape members.

DESCRIPTION OF REFERENCE NUMBERS

6,7 Protruding portion
10 Approximately U-shape member
11 Comb teeth fixed piece
12, 13 Curved elastic leg portion
15 Opening portion

16, 17 Connecting hole
20 Comb teeth

What is claimed is:

1. A fastener for a wig, which is connected to an inside surface of the wig and clamps hair of a wearer of the wig, thereby fixing the wig to the wearer's head, comprising:

first and second approximately U-shape members, wherein the first and second approximately U-shape members are not monolithically formed;

each of the first and second approximately U-shape members includes:

a fixed piece, a plurality of comb teeth fixed to the fixed piece, a first leg and a second leg, wherein each of the first and second legs are curved and elastic and extend in a longitudinal direction, approximately perpendicularly in the same direction from opposing ends of the fixed piece, each of the first and second legs have a connection portion situated at a central location between and away from the fixed piece, where each connection portion includes a plurality of connecting points, the connection portions of the first approximately U-shape member respectively overlap the connection portions of the second approximately U-shape member and the first and second approximately U-shape members are non-adjustably connected to each other via a mechanical fastener at each of the plurality of overlapped connecting points, a single continuous opening bound by each of the first and second legs and the fixed pieces of the first and second approximately U-shape members;

the plurality of connecting points of each of the first legs are separated from each other in the longitudinal direction, the plurality of connecting points of each of the second legs are separated from each other in the longitudinal direction, an open position and a closed position are selected by reversing a bending direction of the first and second legs, in the open position, the comb teeth are raised away from their respective first and second legs, and in the closed position, the comb teeth extend along the longitudinal direction of the first and second legs such that some of the comb teeth contact portions of their respective first and second leg.

2. The fastener for a wig according to claim 1, wherein: the plurality of connecting points comprise:

a first connecting point positioned on the first leg of the first approximately U-shape member, a second connecting point positioned on the first leg of the second approximately U-shape member, a third connecting point positioned on the second leg of the first approximately U-shape member, and a fourth connecting point positioned on the second leg of the second approximately U-shape member.

3. The fastener for a wig according to claim 1, wherein: each of the connecting portions of the first and second approximately U-shape members includes protruding portions which protrude into the single continuous opening, and each of the protruding portions includes one connecting point of the plurality of connecting points.

4. The fastener for a wig according to claim 1, wherein: the mechanical fasteners are caulking pieces.

5. The fastener for a wig according to claim 1, wherein: the two approximately U-shape members are identical components that are bonded together.

6. The fastener for a wig according to claim 1, wherein: a cylindrical member is inserted around the overlapped first and second legs of the first and second approximately U-shape members.

7. A wig comprising the fastener for a wig according to claim 1.

* * * * *